US006922637B2

(12) United States Patent
Ravi et al.

(10) Patent No.: US 6,922,637 B2
(45) **Date of Patent: *Jul. 26, 2005**

(54) METHOD FOR SELECTION OF CEMENTING COMPOSITION

(75) Inventors: Krishna M. Ravi, Kingwood, TX (US); Olivier Gastebled, The Hague (NL); Martin Gerard Rene Bosma, Ryswyk (NL)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/739,430

(22) Filed: Dec. 18, 2003

(65) Prior Publication Data

US 2004/0083058 A1 Apr. 29, 2004

Related U.S. Application Data

(63) Continuation of application No. 10/081,059, filed on Feb. 22, 2002, now Pat. No. 6,697,738.

(51) Int. Cl.[7] ..... G01V 1/40; E21B 33/00
(52) U.S. Cl. ..... 702/6; 166/285
(58) Field of Search ..... 702/6; 703/9, 10; 166/285

(56) References Cited

U.S. PATENT DOCUMENTS

| | | | | |
|---|---|---|---|---|
| 5,265,247 A | | 11/1993 | Wienck et al. | 395/600 |
| 5,348,093 A | * | 9/1994 | Wood et al. | 166/250.14 |
| 5,375,661 A | * | 12/1994 | Daneshy et al. | 166/278 |
| 5,455,780 A | * | 10/1995 | Nguyen et al. | 703/9 |
| 5,896,927 A | * | 4/1999 | Roth et al. | 166/285 |
| 6,296,057 B2 | | 10/2001 | Thiercelin | 166/285 |
| 6,488,089 B1 | * | 12/2002 | Bour et al. | 166/292 |
| 6,516,884 B1 | * | 2/2003 | Chatterji et al. | 166/294 |
| 6,562,122 B2 | * | 5/2003 | Dao et al. | 106/705 |
| 6,626,243 B1 | * | 9/2003 | Go Boncan | 166/293 |
| 6,668,928 B2 | * | 12/2003 | Brothers | 166/292 |
| 6,732,797 B1 | * | 5/2004 | Watters et al. | 166/291 |
| 6,776,237 B2 | * | 8/2004 | Dao et al. | 166/292 |
| 6,799,636 B2 | * | 10/2004 | Funkhouser et al. | 166/293 |

FOREIGN PATENT DOCUMENTS

| | | | |
|---|---|---|---|
| EP | 0 903 462 A1 | 3/1999 | E21B/33/14 |
| WO | WO/03/071094 | 8/2003 | |

OTHER PUBLICATIONS

"Design Approach to Sealant Selection for the Life of the Well", Bosma et al., SPE 56536, 1999.*
"Mechanical Property Issues for Geothermal Well Cements", Philippacopoulos et al., Geothermal Resources Council Transactions, vol. 25, 119–124, San Diego, 2001.*
Bosma et al., Design Approach to Sealant Selection for the Life of the Well, 1999, SPE 56536, pp. 283–296.*
M. J. Thiercelin, et al.; *Cement Design Based on Cement Mechanical Response*; SPE 38598, 1997.
Gino Di Lulio, et al.; *Cements for Long Term Isolation—Design Optimization by Computer Modelling and Prediction*; SPE 62745, 2000.

(Continued)

*Primary Examiner*—Michael Nghiem
*Assistant Examiner*—Toan M. Le
(74) *Attorney, Agent, or Firm*—Craig W. Roddy; Haynes and Boone, LLP

(57) ABSTRACT

A method is provided for selecting a cementing composition for sealing a subterranean zone penetrated by a well bore. The method involves determining a group of effective cementing compositions from a group of cementing compositions given estimated conditions experienced during the life of the well, and estimating the risk parameters for each of the group of effective cementing compositions.

34 Claims, 8 Drawing Sheets

OTHER PUBLICATIONS

Communication from the U.S. International Searching Authority, dated Jun. 10, 2003, regarding International Application No. PCT/GB03/00774, which is a counterpart to U.S. Appl. No. 10/081,059 and which is related to U.S. Appl. No. 10/739,430.
Communication from the International Preliminary Examining Authority, dated Oct. 23, 2003, regarding International Application No. PCT/GB03/00774, which is a counterpart to U.S. Appl. No. 10/081,059 and which is related to U.S. Appl. No. 10/739,430.
Communication from the U.S. Patent and Trademark Office, dated Nov. 4, 2003, regarding U.S. Appl. No. 10/081,059, which is the parent application of U.S. Appl. No. 10/739, 430.
SPE 11204 entitled "Foamed Cement—Solving Old Problems with a New Technique" by O.G. Benge et al., dated 1982.
SPE 26572 entitled "Elastomeric Composites for Use in Well Cementing Operations" by D.D. Onan et al., dated 1993.
SPE 26736 entitled "Optimising Shale Drilling in the Northern North Sea: Borehole Stability Considerations" by Sau–Wong et al., dated 1993.
SPE 56536 entitled "Design Approach to Sealant Selection for the Life Of the Well" by Martin Bosma et al., dated 1999.
Article entitled "Petroleum Related Rock Mechanics" by Erling FJER et al., pp. 51–58, dated 1992.
Article entitled "Transport Phenomena" by R. Byron Bird et al., pp. 352–374, dated 1960.
Article entitled "Cement Sheath Stress Failure" by K.J. Goodwin et al., Dated 1992.
Article entitled "Cement Design Based on Cement Mechanical Response" by M.J. Thiercelin et al., dated 1998.
DIANA–7.2 User's Manual—Nonlinear Analysis, Fourth Ed., Section 8.1.5 Mohn–Coulmb through Section 8.24, dated 2000.
Article entitled "Mechanical Property Issues for Geothermal Well Cements," by A.J. Philippacopoulos et al. dated 2001.
SPE 56534 entitled "Deepwater Cementing Challenges," by Krishna M. Ravi et al., dated 1999.
Paper entitled "Cements for Long Term Isolation—Design Optimization By Computer Modelling and Prediction," by Gino di Lullo et al., dated 2000.
SPE 62887 entitled "Experimental and Numerical Study of Drilling Fluid Removal From a Horizontal Wellbore," by Ewout Biezen et al., dated 2000.

* cited by examiner

METHOD FOR SELECTION OF CEMENTING COMPOSITION

CROSS-REFERENCE TO RELATED APPLICATIONS

This application is a continuation of prior application Ser. No. 10/081,059 filed Feb. 22, 2002 (now U.S. Pat. No. 6,697,738) by Krishna M. Ravi et al., the entire disclosure of which is incorporated herein by reference.

BACKGROUND

The present embodiment relates generally to a method for selecting a cementing composition for sealing a subterranean zone penetrated by a well bore.

In the drilling and completion of an oil or gas well, a cementing composition is often introduced in the well bore for cementing pipe string or casing. In this process, known as "primary cementing," a cementing composition is pumped into the annular space between the walls of the well bore and the casing. The cementing composition sets in the annular space, supporting and positioning the casing, and forming a substantially impermeable barrier, or cement sheath, which divides the well bore into subterranean zones.

If the short-term properties of the cementing composition, such as density, static gel strength, and rheology are designed as needed, the undesirable migration of fluids between zones is prevented immediately after primary cementing. However, changes in pressure or temperature in the well bore over the life of the well can compromise zonal integrity. Also, activities undertaken in the well bore, such as pressure testing, well completion operations, hydraulic fracturing, and hydrocarbon production can affect zonal integrity. Such compromised zonal isolation is often evident as cracking or plastic deformation in the cementing composition, or de-bonding between the cementing composition and either the well bore or the casing. Compromised zonal isolation affects safety and requires expensive remedial operations, which can comprise introducing a sealing composition into the well bore to reestablish a seal between the zones.

A variety of cementing compositions have been used for primary cementing. In the past, cementing compositions were selected based on relatively short term concerns, such as set times for the cement slurry. Further considerations regarding the cementing composition include that it be environmentally acceptable, mixable at the surface, non-settling under static and dynamic conditions, develop near one hundred percent placement in the annular space, resist fluid influx, and have the desired density, thickening time, fluid loss, strength development, and zero free water.

However, in addition to the above, what is needed is a method for selecting a cementing composition for sealing a subterranean zone penetrated by a well bore that focuses on relatively long term concerns, such as maintaining the integrity of the cement sheath under conditions that may be experienced during the life of the well.

DETAILED DESCRIPTION

Figure 1:
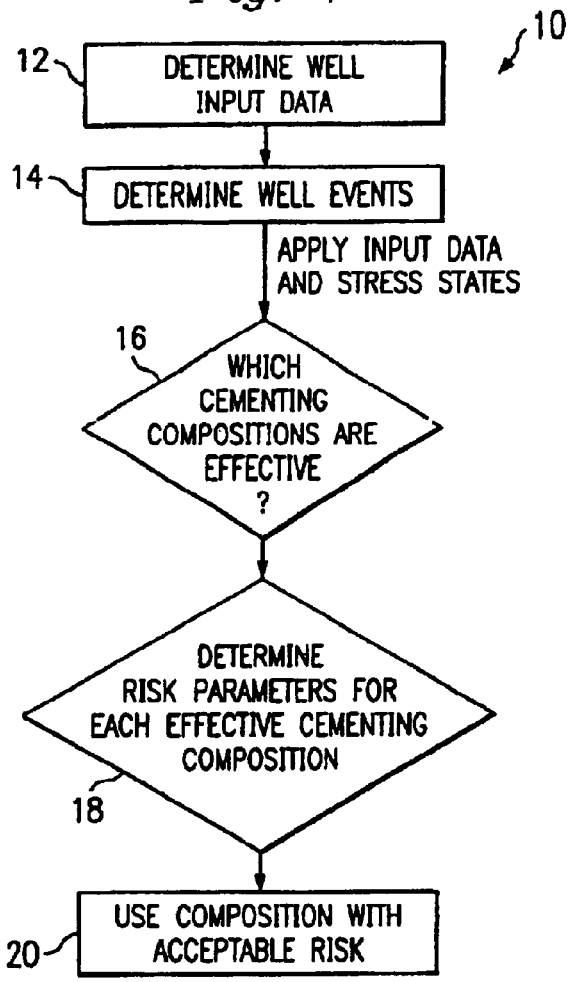
FIG. 1 is a flowchart of a method for selecting between a group of cementing compositions according to one embodiment of the present invention.

Referring to FIG. 1, a method 10 for selecting a cementing composition for sealing a subterranean zone penetrated by a well bore according to the present embodiment basically comprises determining a group of effective cementing compositions from a group of cementing compositions given estimated conditions experienced during the life of the well, and estimating the risk parameters for each of the group of effective cementing compositions. Effectiveness considerations include concerns that the cementing composition be stable under down hole conditions of pressure and temperature, resist down hole chemicals, and possess the mechanical properties to withstand stresses from various down hole operations to provide zonal isolation for the life of the well.

In step 12, well input data for a particular well is determined. Well input data includes routinely measurable or calculable parameters inherent in a well, including vertical depth of the well, overburden gradient, pore pressure, maximum and minimum horizontal stresses, hole size, casing outer diameter, casing inner diameter, density of drilling fluid, desired density of cement slurry for pumping, density of completion fluid, and top of cement. As will be discussed in greater detail with reference to step 16, the well can be computer modeled. In modeling, the stress state in the well at the end of drilling, and before the cement slurry is pumped into the annular space, affects the stress state for the interface boundary between the rock and the cementing composition. Thus, the stress state in the rock with the drilling fluid is evaluated, and properties of the rock such as Young's modulus, Poisson's ratio, and yield parameters are used to analyze the rock stress state. These terms and their methods of determination are well known to those skilled in the art. It is understood that well input data will vary between individual wells.

In step 14, the well events applicable to the well are determined. For example, cement hydration (setting) is a well event. Other well events include pressure testing, well completions, hydraulic fracturing, hydrocarbon production, fluid injection, perforation, subsequent drilling, formation movement as a result of producing hydrocarbons at high rates from unconsolidated formation, and tectonic movement after the cementing composition has been pumped in place. Well events include those events that are certain to happen during the life of the well, such as cement hydration, and those events that are readily predicted to occur during the life of the well, given a particular well's location, rock type, and other factors well known in the art.

Each well event is associated with a certain type of stress, for example, cement hydration is associated with shrinkage, pressure testing is associated with pressure, well completions, hydraulic fracturing, and hydrocarbon production are associated with pressure and temperature, fluid injection is associated with temperature, formation movement is associated with load, and perforation and subsequent drilling are associated with dynamic load. As can be appreciated, each type of stress can be characterized by an equation for the stress state (collectively "well event stress states").

Figure 2A:
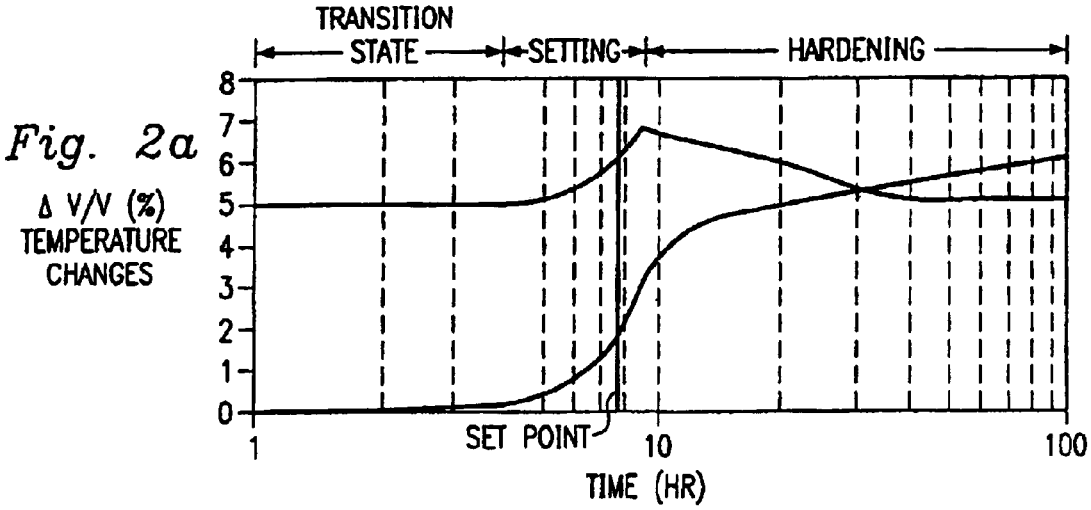
FIG. 2*a* is a graph relating to shrinkage versus time for cementing composition curing.
Figure 2B:
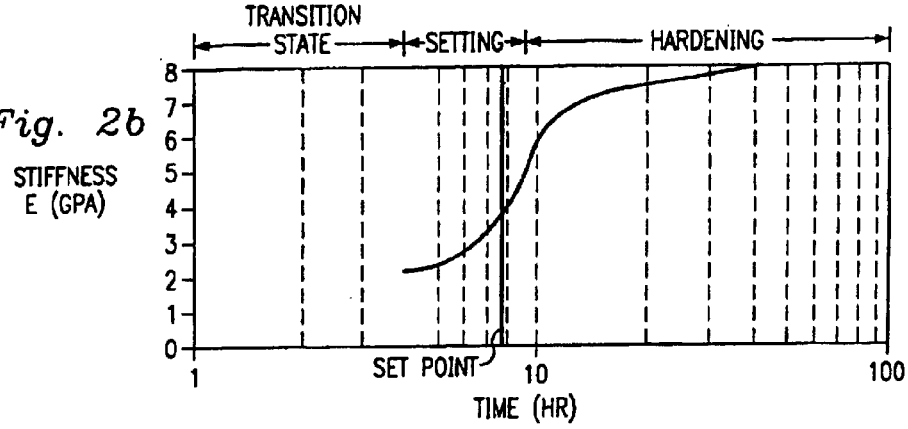
FIG. 2*b* is a graph relating to stiffness versus time for cementing composition curing.
Figure 2C:
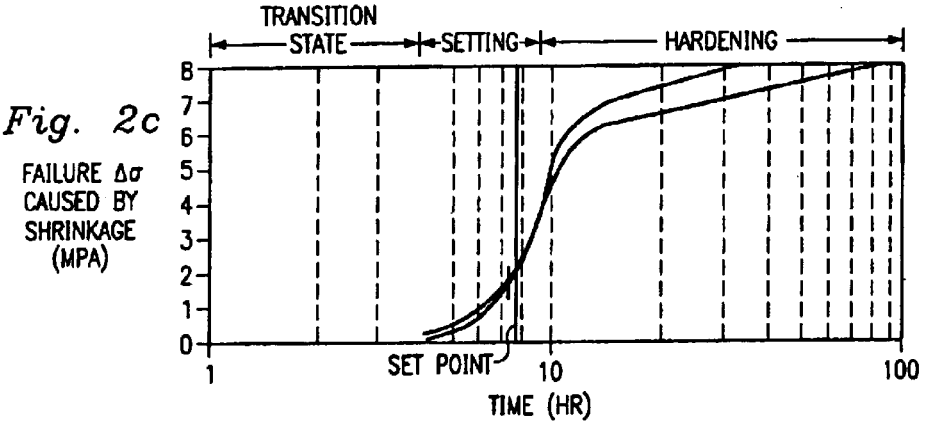
FIG. 2*c* is a graph relating to failure versus time for cementing composition curing.

For example, the stress state in the cement slurry during and after cement hydration is important and is a major factor affecting the long-term integrity of the cement sheath. Referring to FIGS. 2*a–c*, the integrity of the cement sheath depends on the shrinkage and Young's modulus of the setting cementing composition. The stress state of cementing compositions during and after hydration can be determined. Since the elastic stiffness of the cementing compositions evolves in parallel with the shrinkage process, the total maximum stress difference can be calculated from Equation 1:

$$\Delta\sigma_{sh} = k\int_{\varepsilon_{sh}^{set}}^{\varepsilon_{sh}^{tot}} E_{(\varepsilon_{sh})}\cdot d\varepsilon_{sh} \qquad \text{(Equation 1)}$$

where:

$\Delta\sigma_{sh}$ is the maximum stress difference due to shrinkage k is a factor depending on the Poisson ratio and the boundary conditions $E_{(\epsilon_{sh})}$ is the Young's modulus of the cement depending on the advance of the shrinkage process $\epsilon_{sh}$ is the shrinkage at a time (t) during setting or hardening As can be appreciated, the integrity of the cement sheath during subsequent well events is associated with the initial stress state of the cement slurry. One or more of tensile strength experiments, unconfined and confined tri-axial experimental tests, hydrostatic and oedometer tests are used to define the material behavior of different cementing compositions, and hence the properties of the resulting cement sheath. Such experimental measurements are complementary to conventional tests such as compressive strength, porosity, and permeability. From the experimental measurements, the Young's modulus, Poisson's Ratio, and yield parameters, such as the Mohr-Coulomb plastic parameters (i.e. internal friction angle, "a", and cohesiveness, "c"), of a cement composition are all known or readily determined (collectively "the cement data"). Yield parameters can also be estimated from other suitable material models such as Drucker Prager, Modified Cap, and Egg-Clam-Clay. Of course, the present embodiment can be applied to any cement composition, as the physical properties can be measured, and the cement data determined. Although any number of known cementing compositions are contemplated by this disclosure, the following examples relate to three basic types of cementing compositions.

Returning to FIG. 1, in step 16, the well input data, the well event stress states, and the cement data are used to determine the effect of well events on the integrity of the cement sheath during the life of the well for each of the cementing compositions. The cementing compositions that would be effective for sealing the subterranean zone and their capacity from its elastic limit are determined.

Figure 3A:
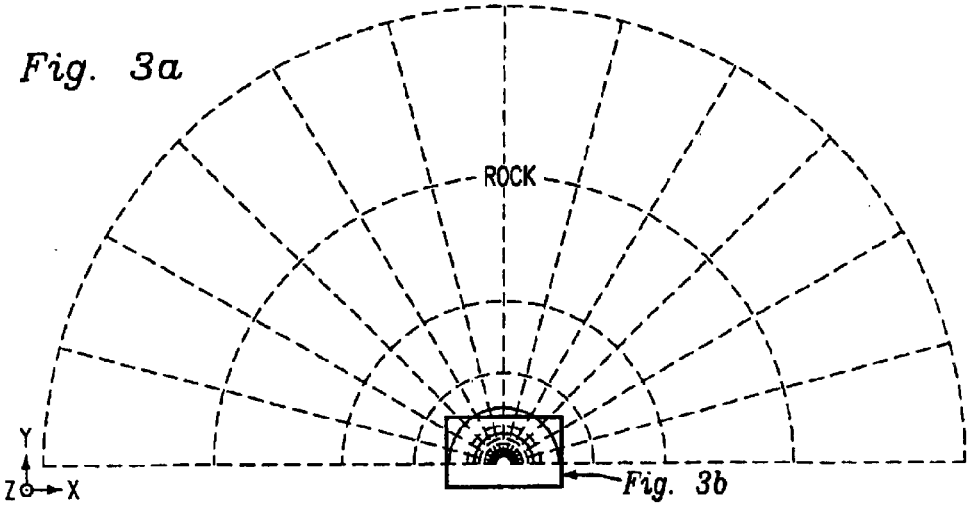
FIG. 3*a* is a cross-sectional diagrammatic view of a portion of a well after primary cementing.
Figure 3B:
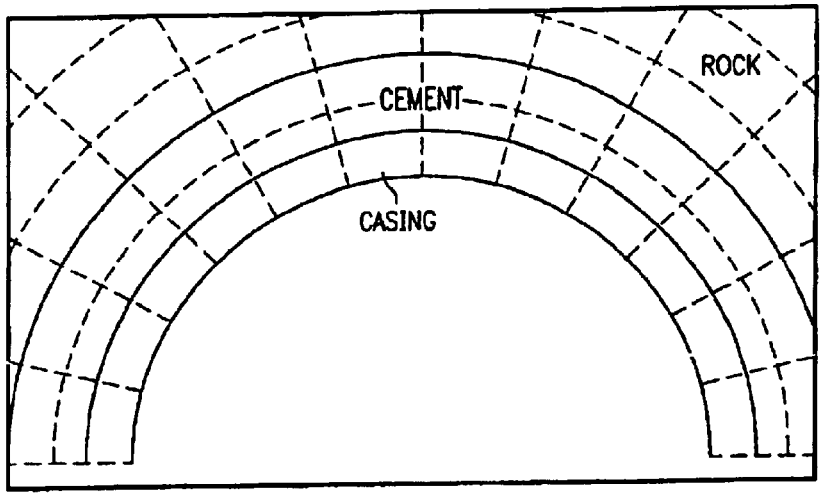
FIG. 3*b* is a detail view of FIG. 3*a*.

In one embodiment, step 16 comprises using Finite Element Analysis to assess the integrity of the cement sheath during the life of the well. One software program that can accomplish this is the WELLLIFE™ software program, available from Halliburton Company, Houston, Tex. The WELLLIFE™ software program is built on the DIANA™ Finite Element Analysis program, available from TNO Building and Construction Research, Delft, the Netherlands. As shown in FIGS. 3*a–b*, the rock, cement sheath, and casing can be modeled for use in Finite Element Analysis.

Returning to FIG. 1, for purposes of comparison in step 16, all the cement compositions are assumed to behave linearly as long as their tensile strength or compressive shear strength is not exceeded. The material modeling adopted for the undamaged cement is a Hookean model bounded by smear cracking in tension and Mohr-Coulomb in the compressive shear. Shrinkage and expansion (volume change) of the cement compositions are included in the material model. Step 16 concludes by determining which cementing compositions would be effective in maintaining the integrity of the resulting cement sheath for the life of the well.

In step 18, parameters for risk of cement failure for the effective cementing compositions are determined. For example, even though a cement composition is deemed effective, one cement composition may be more effective than another. In one embodiment, the risk parameters are calculated as percentages of cement competency during the determination of effectiveness in step 16.

Step 18 provides data that allows a user to perform a cost benefit analysis. Due to the high cost of remedial operations, it is important that an effective cementing composition is selected for the conditions anticipated to be experienced during the life of the well. It is understood that each of the cementing compositions has a readily calculable monetary cost. Under certain conditions, several cementing compositions may be equally efficacious, yet one may have the added virtue of being less expensive. Thus, it should be used to minimize costs. More commonly, one cementing composition will be more efficacious, but also more expensive. Accordingly, in step 20, an effective cementing composition with acceptable risk parameters is selected given the desired cost.

The following examples are illustrative of the methods discussed above.

EXAMPLE 1

A vertical well was drilled, and well input data was determined as listed in TABLE 1.

TABLE 1

| Input Data | Input Data for Example 1 |
|---|---|
| Vertical Depth | 16,500 ft (5,029 m) |
| Overburden gradient | 1.0 psi/ft (22.6 kPA/m) |
| Pore pressure | 12.0 lbs/gal (1,438 kg/m$^3$) |
| Min. Horizontal stress | 0.78 |
| Max. Horizontal stress | 0.78 |
| Hole size | 9.5 inches (0.2413 m) |
| Casing OD | 7.625 inches (0.1936 m) |
| Casing ID | 6.765 inches (0.1718 m) |
| Density of drilling fluid | 13 lbs/gal (1,557 kg/m$^3$) |
| Density of cement slurry | 16.4 lbs/gal (1,965 kg/m$^3$) |
| Density of completion fluid | 8.6 lbs/gal (1,030 kg/m$^3$) |
| Top of cement | 13,500 feet (4115 m) |

Cement Type 1 is a conventional oil well cement with a Young's modulus of 1.2 e+6 psi (8.27 GPa), and shrinks typically four percent by volume upon setting. In a first embodiment, Cement Type 1 comprises a mixture of a cementitious material, such as Portland cement API Class G, and sufficient water to form a slurry.

Cement Type 2 is shrinkage compensated, and hence the effective hydration volume change is zero percent. Cement Type 2 also has a Young's modulus of 1.2 e+6 psi (8.27 GPa), and other properties very similar to that of Cement Type 1. Cement Type 2 comprises a mixture of Class G cement, water, and an in-situ gas generating additive to compensate for down hole volume reduction.

Cement Type 3 is both shrinkage compensated and is of lower stiffness compared to Cement Type 1. Cement Type 3 has an effective volume change during hydration of zero percent and a Young's modulus of 1.35 e+5 psi (0.93 GPa). For example, Cement Type 3 comprises a foamed cement mixture of Class G cement, water, surfactants and nitrogen dispersed as fine bubbles into the cement slurry, in required quantity to provide the required properties. Cement 3 may also be a mixture of Class G cement, water, suitable polymer (s), an in-situ gas generating additive to compensate for shrinkage. Cement Types 1–3 are of well known compositions and are well characterized.

In one embodiment, the modeling can be visualized in phases. In the first phase, the stresses in the rock are evaluated when a 9.5" hole is drilled with the 13 lbs/gal drilling fluid. These are the initial stress conditions when the casing is run and the cementing composition is pumped. In the second phase, the stresses in the 16.4 lbs/gal cement slurry and the casing are evaluated and combined with the conditions from the first phase to define the initial conditions as the cement slurry is starting to set. These initial conditions constitute the well input data.

Figure 4:
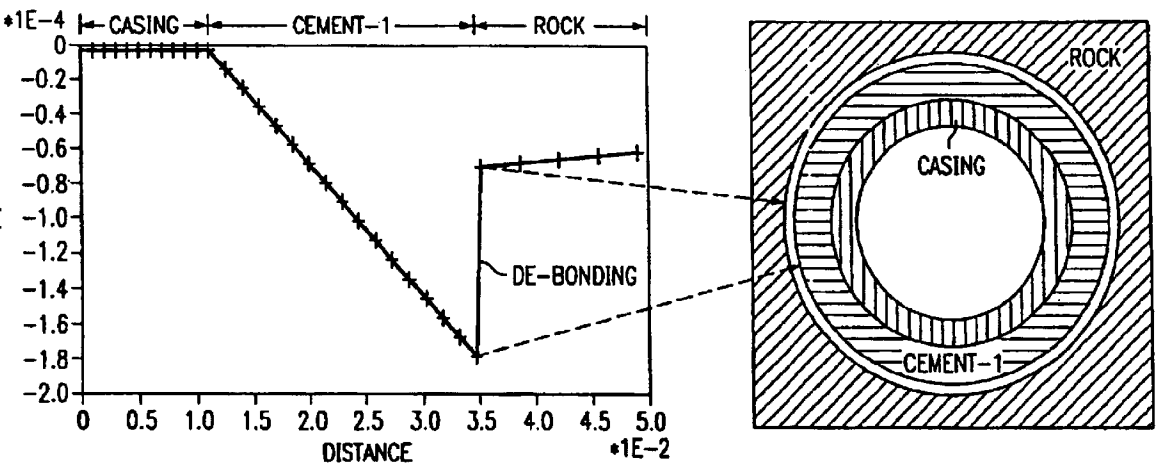
FIG. 4 is a diagrammatic view of a well with a graph showing de-bonding of the cement sheath.

In the third phase, the cementing composition sets. As shown in FIG. 4, Cement Type 1, which shrinks by four percent during hydration, de-bonds from the cement-rock interface and the de-bonding is on the order of approximately 115 $\mu$m during cement hydration. Therefore, zonal isolation cannot be obtained with this type of cement, under the well input data set forth in TABLE 1. Although not depicted, Cement Type 2 and Cement Type 3 did not fail. Hence, Cement Type 2 and Cement Type 3 should provide zonal isolation under the well input data set forth in TABLE 1, at least during the well construction phases.

The well of EXAMPLE 1 had two well events. The first well event was swapping drilling fluid for completion fluid. The well event stress states for the first event comprised passing from a 13 lbs/gal density fluid to an 8.6 lbs/gal density fluid. At a vertical depth of 16,500 feet this amounts to reducing the pressure inside the casing by 3,775 psi (26.0 MPa). The second well event was hydraulic fracturing. The well event stress states for the second event comprised increasing the applied pressure inside the casing by 10,000 psi (68.97 MPa).

Figure 5:
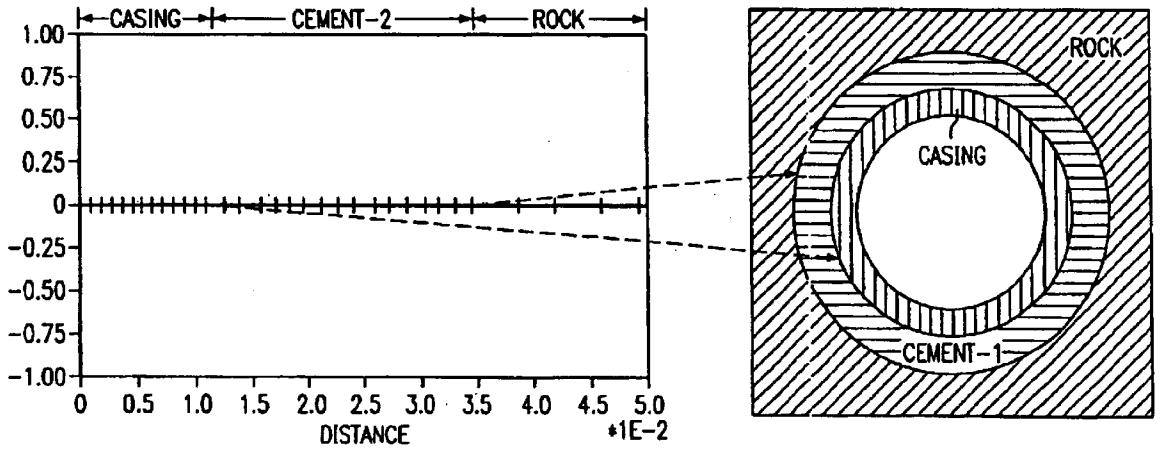
FIG. 5 is a diagrammatic view of a well with a graph showing no de-bonding of the cement sheath.

In the fourth phase (first well event), drilling fluid is swapped for completion fluid. Cement Type 1 de-bonded even further, and the de-bonding increased to 190 $\mu$m. As shown in FIG. 5, Cement Type 2 did not de-bond. Although not depicted, Cement Type 3 also did not de-bond.

Figure 6:
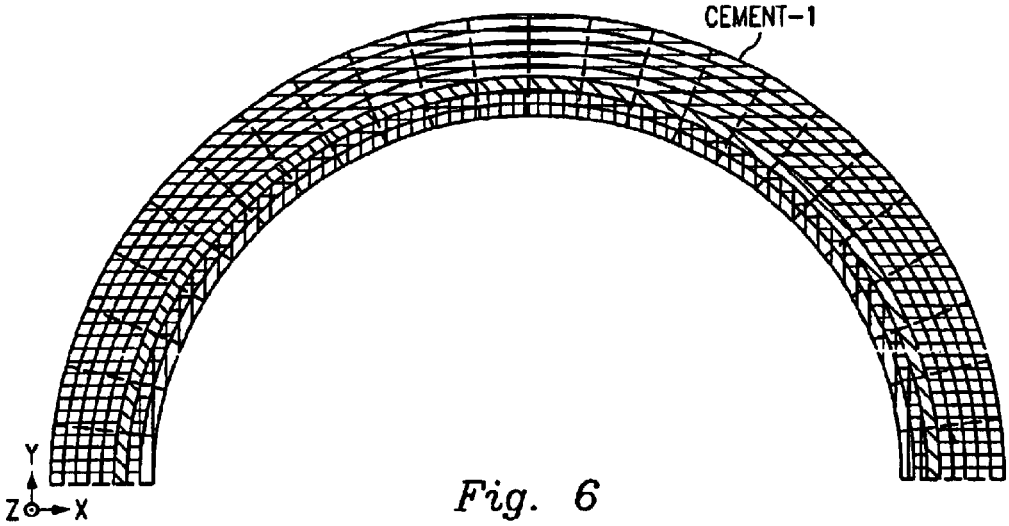
FIG. 6 is a diagrammatic view of a well showing plastic deformation of the cement sheath.

In the fifth phase (second well event), a hydraulic fracture treatment was applied. As depicted in FIG. 6, Cement Type 1 succumbed to permanent deformation or plastic failure adjacent to the casing when subjected to an increase in pressure inside the casing.

Figure 7:
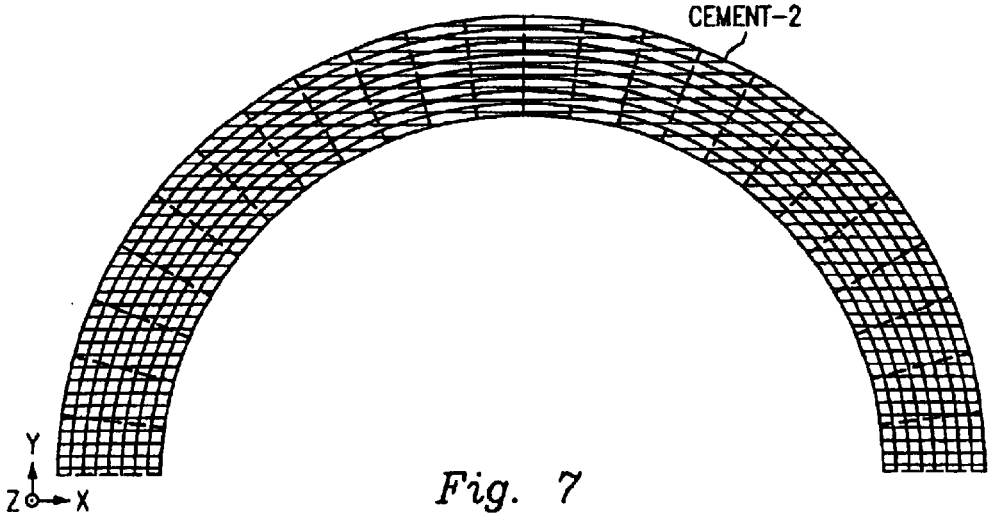
FIG. 7 is a diagrammatic view of a well showing no plastic deformation of the cement sheath.

As depicted in FIG. 7, an increase in pressure inside the casing did not cause Cement Type 2 to fail. Although not depicted, Cement Type 3 also did not fail, and therefore Cement Type 2 and Cement Type 3 were capable of maintaining zonal isolation during all operational loadings envisaged for the well for EXAMPLE 1. Thus, in this example, both Cement Type 2 and Cement Type 3 are effective.

Figure 8A:
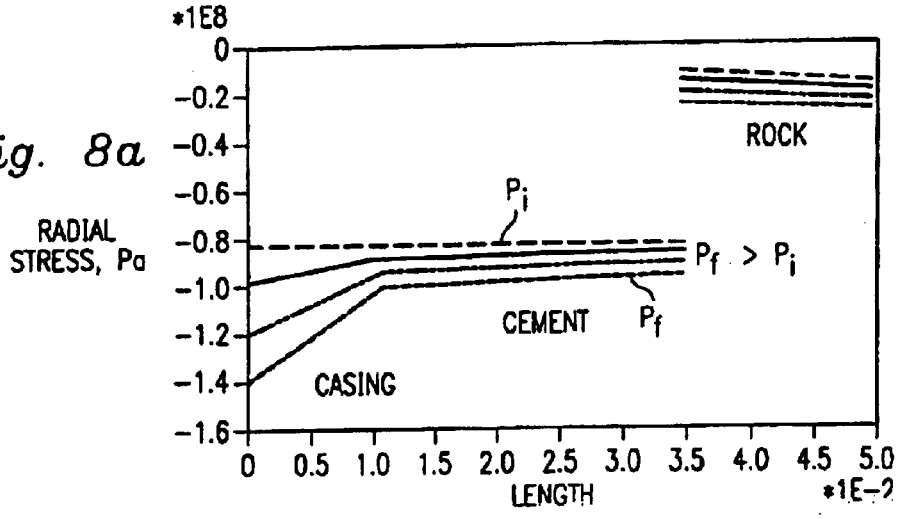
FIG. 8*a* is a graph relating to radial stresses in the casing, cement and the rock when the pressure inside the casing is increased.
Figure 8B:
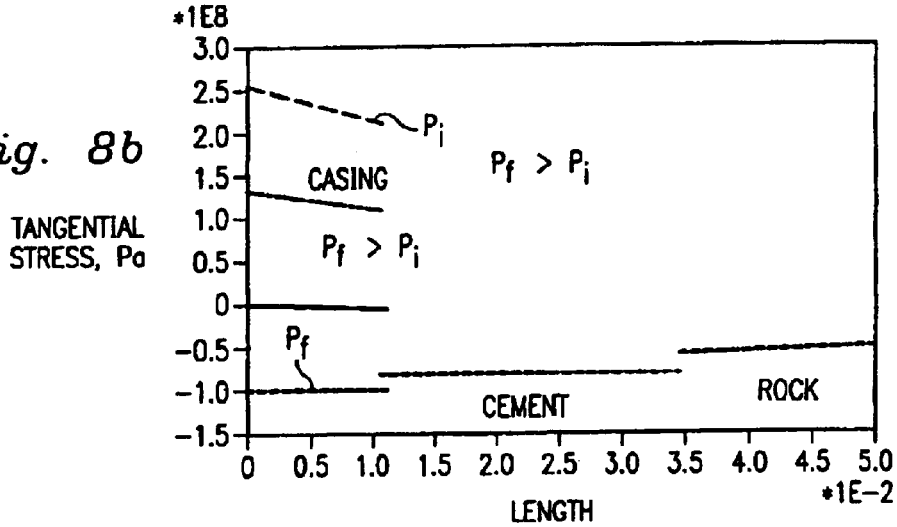
FIG. 8*b* is a graph relating to tangential stresses in the casing, cement and the rock when the pressure inside the casing is increased.
Figure 8C:
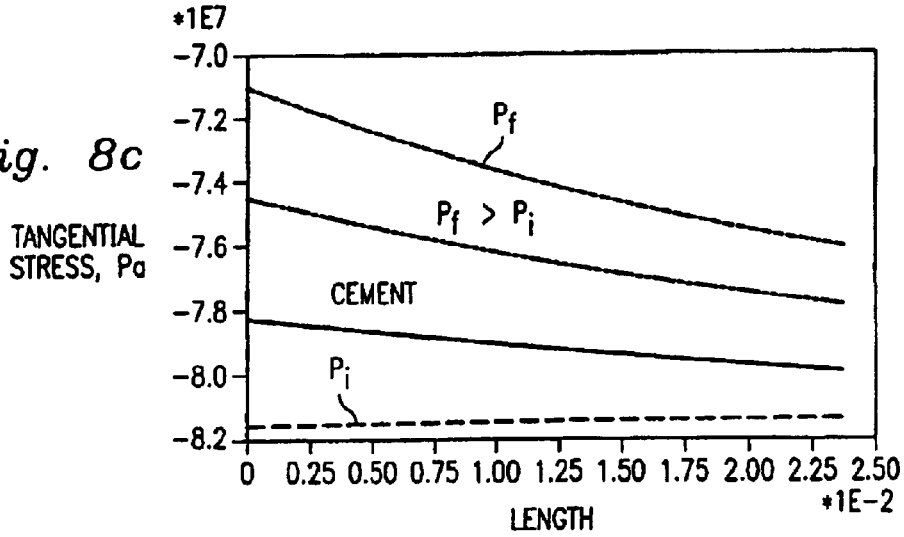
FIG. 8*c* is a graph relating to tangential stresses in a cement sheath when the pressure inside the casing is increased.
Figure 8D:
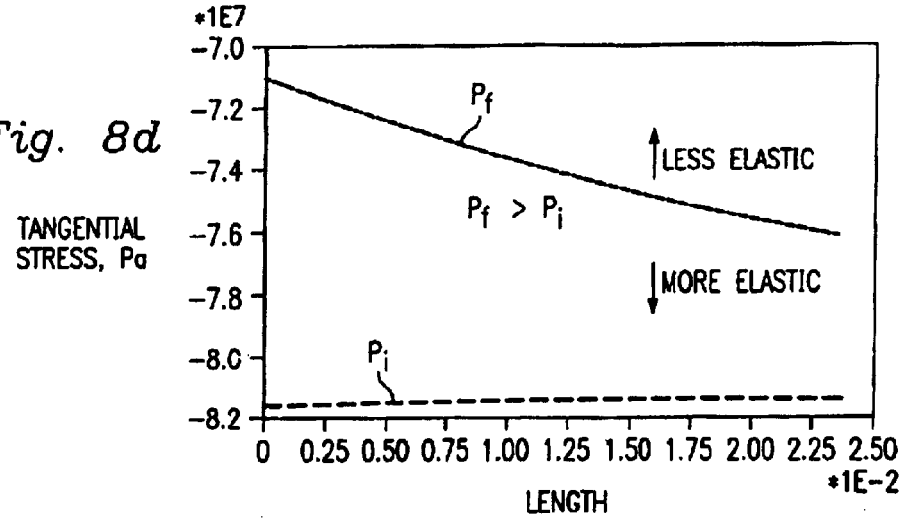
FIG. 8*d* is a graph relating to tangential stresses in several cement sheaths when the pressure inside the casing is increased.

FIGS. 8*a*–*d* show stresses in the cement sheath when the pressure inside the casing was increased by 10,000 psi. FIG. 8*a* shows radial stresses in the casing, cement and the rock. This shows that the radial stress becomes more compressive in the casing, cement and the rock when the pressure is increased. FIG. 8*b* shows tangential stresses in casing, cement and the rock. FIG. 8*b* shows that tangential stress becomes less compressive when the pressure is increased. FIG. 8*c* shows tangential stress in the cement sheath. As stated earlier, tangential stress becomes less compressive as the pressure increases. For a certain combination of cement sheath properties, down hole conditions and well events, as the tangential stress gets less compressive, it could become tensile. If the tensile stress in the cement sheath is greater than the tensile strength of the cement sheath, the cement will crack and fail. FIG. 8*d* compares the tangential stresses of different cement sheaths. Again, as the pressure increases, the less elastic the cement is, and the tangential stress becomes less compressive than what it was initially, and could become tensile. The more elastic the cement is as the pressure increases, the tangential stress becomes less compressive than what it was initially, but it is more compressive than a rigid cement. This shows that, everything else remaining the same, as the cement becomes more elastic, the tangential stress remains more compressive than in less elastic cement. Thus, a more elastic cement is less likely to crack and fail when the pressure or temperature is increased inside the casing.

Figure 9:
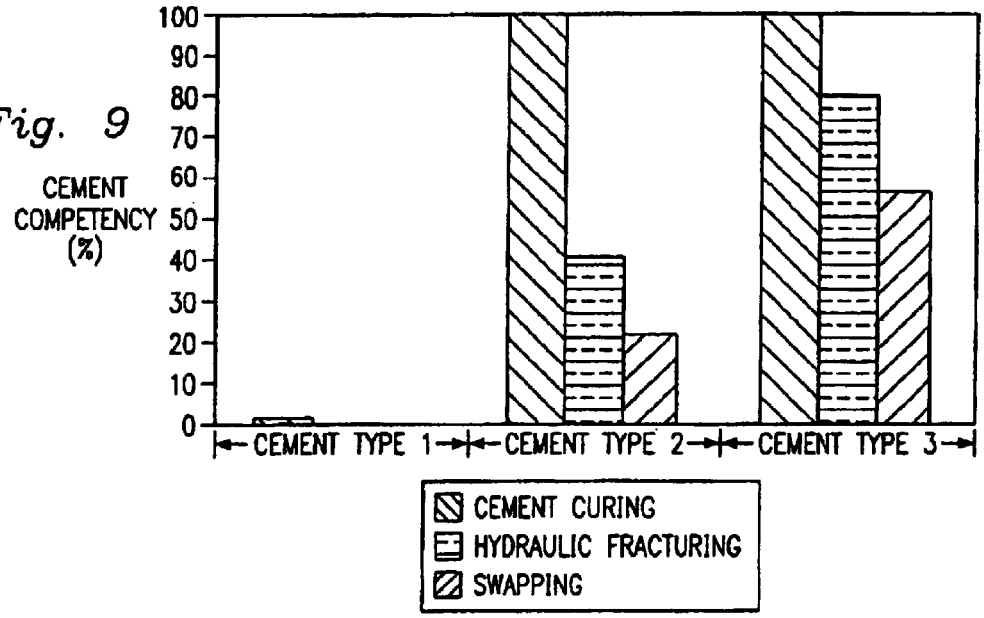
FIG. 9 is a diagrammatic view of a well showing no de-bonding of the cement sheath.

Referring to FIG. 9, risk parameters as percentages of cement competency are shown for the cementing compositions. Accordingly, an effective cementing composition (Cement Type 2 or Cement Type 3) with acceptable risk parameters given the desired cost would be selected.

EXAMPLE 2

A vertical well was drilled, and well input data was determined as listed in TABLE 2.

TABLE 2

| Input Data | Input Data for Example 2 |
|---|---|
| Vertical Depth | 20,000 ft (6,096 m) |
| Overburden gradient | 1.0 psi/ft (22.6 kPA/m) |
| Pore pressure | 14.8 lbs/gal (1,773 kg/m$^3$) |
| Min. Horizontal stress | 0.78 |
| Max. Horizontal stress | 0.78 |
| Hole size | 8.5 inches (0.2159 m) |
| Casing OD | 7 inches (0.1778 m) |

TABLE 2-continued

| Input Data | Input Data for Example 2 |
|---|---|
| Casing ID | 6.094 inches (0.1548 m) |
| Density of drilling fluid | 15 lbs/gal (1,797 kg/m$^3$) |
| Density of cement slurry | 16.4 lbs/gal (1,965 kg/m$^3$) |
| Density of completion fluid | 8.6 lbs/gal (1,030 kg/m$^3$) |
| Top of cement | 16,000 feet (4,877 m) |

Cement Type 1 is a conventional oil well cement with a Young's modulus of 1.2 e+6 psi (8.27 GPa), and shrinks typically four percent by volume upon setting. In a first embodiment, Cement Type 1 comprises a mixture of a cementitious material, such as Portland cement API Class G, and sufficient water to form a slurry.

Cement Type 2 is shrinkage compensated, and hence the effective hydration volume change is zero percent. Cement Type 2 also has a Young's modulus of 1.2 e+6 psi (8.27 GPa), and other properties very similar to that of Cement Type 1. Cement Type 2 comprises a mixture of Class G cement, water, and an in-situ gas generating additive to compensate for down hole volume reduction.

Cement Type 3 is both shrinkage compensated and is of lower stiffness compared to Cement Type 1. Cement Type 3 has an effective volume change during hydration of zero percent and a Young's modulus of 1.35 e+5 psi (0.93 GPa). For example, Cement Type 3 comprises a foamed cement mixture of Class G cement, water, surfactants and nitrogen dispersed as fine bubbles into the cement slurry, in required quantity to provide the required properties. Cement 3 may also be a mixture of Class G cement, water, suitable polymer(s), an in-situ gas generating additive to compensate for shrinkage. Cement Types 1–3 are of well known compositions and are well characterized.

In one embodiment, the modeling can be visualized in phases. In the first phase, the stresses in the rock are evaluated when an 8.5" hole is drilled with the 15 lbs/gal drilling fluid. These are the initial stress conditions when the casing is run and the cementing composition is pumped. In the second phase, the stresses in the 16.4 lbs/gal cement slurry and the casing are evaluated and combined with the conditions from the first phase to define the initial conditions as the cement slurry is starting to set. These initial conditions constitute the well input data.

In the third phase, the cementing composition sets. From the previous EXAMPLE 1, it is know that Cement Type 1, which shrinks by four percent during hydration, de-bonds from the cement-rock interface (FIG. 4). Therefore, zonal isolation cannot be obtained with this type of cement according to the well input data set forth in TABLE 1 and TABLE 2. As Cement Type 2 and Cement Type 3 have no effective volume change during hydration, both should provide zonal isolation under the well input data set forth in TABLE 2, at least during the well construction phases.

The well of EXAMPLE 2 had one well event, swapping drilling fluid for completion fluid. The well event (fourth phase) stress states for the well event comprised passing from a 15 lbs/gal density fluid to an 8.6 lbs/gal density fluid. At a depth of 20,000 feet this amounts to changing the pressure inside the casing by 6,656 psi (45.9 MPa). Although not depicted, simulation results showed that Cement Type 2 did de-bond when subjected to a 6,656 psi decrease in pressure inside the casing. Further it was calculated that the de-bonding created an opening (micro-annulus) at the cement-rock interface on the order of 65 $\mu$m. This cement therefore did not provide zonal isolation during the first event under the well input data set forth in TABLE 2, and of course, any subsequent production operations. The effect of a 65 $\mu$m micro-annulus at the cement-rock interface is that fluids such as gas or possibly water could enter and pressurize the production annular space and/or result in premature water production.

Figure 11:
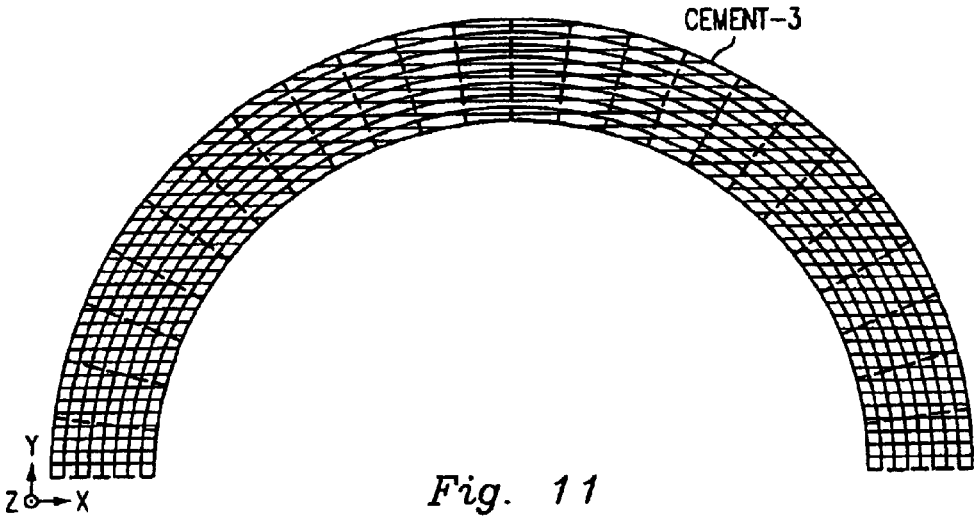
FIG. 11 is a graph relating to competency for the cementing compositions for several well events.
Figure 10:
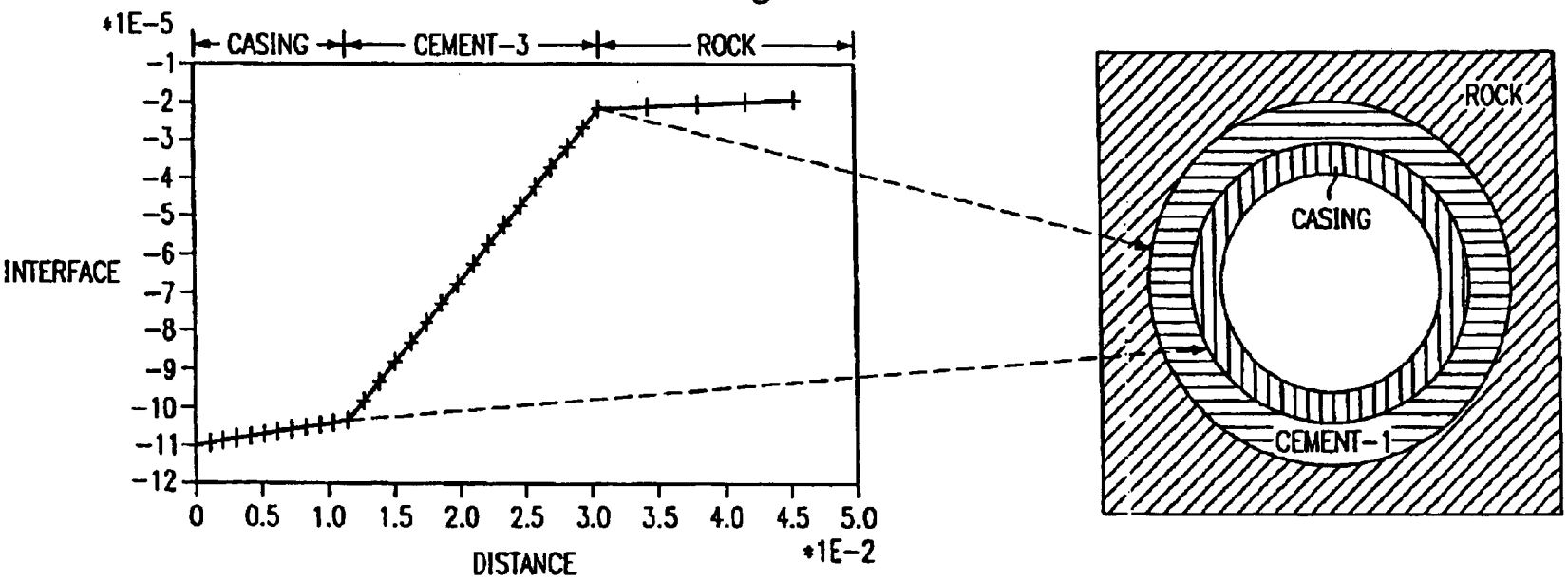
FIG. 10 is a diagrammatic view of a well showing no plastic deformation of the cement sheath.

As shown in FIG. 10, Cement Type 3 did not de-bond when subjected to a 6,656 psi decrease in pressure inside the casing under the well input data set forth in TABLE 2. Also, as shown in FIG. 11, Cement Type 3 did not undergo any plastic deformation under these conditions. Thus, Cement Type 1 and Cement Type 2 do not provide zonal integrity for this well. Only Cement Type 3 will provide zonal isolation under the well input data set forth in TABLE 2, and meet the objective of safe and economic oil and gas production for the life span of the well.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. A method for selecting a cementing composition intended for use in a subterranean zone penetrated by a well bore comprising:

determining a total maximum stress difference for a cementing composition using data from the cementing composition;

determining well input data;

comparing the well input data to the total maximum stress difference to determine whether the cementing composition is effective for the intended use.

2. The method of claim 1 wherein the data from the cementing composition comprises at least one of tensile strength, unconfined and confined tri-axial data, hydrostatic data, oedometer data, compressive strength, porosity, permeability, Young's modulus, Poisson's Ratio, and Mobr-Coulomb plastic parameters.

3. The method of claim 1 wherein the total maximum stress difference is determined according to the formula $$\Delta\sigma_{sh} = k\int_{\varepsilon_{sh}^{set}}^{\varepsilon_{sh}^{tot}} E_{(\varepsilon_{sh})}\cdot d\varepsilon_{sh}$$

where:

$\Delta\sigma_{sh}$ is the total maximum stress difference;

k is a factor depending on the Poisson ratio of the cementing composition and the boundary conditions between rock in the subterranean zone penetrated by the wellbore and the cementing composition;

$E_{(\epsilon_{sh})}$ is the Young's modulus of the cementing composition;

$\epsilon_{sh}$ represents shrinkage of the cementing composition at a time during setting.

4. The method of claim 1 wherein said determining of the well input data comprises determining at least one of vertical depth of the well, overburden gradient, pore pressure, maximum and minimum horizontal stresses, hole size, casing outer diameter, casing inner diameter, density of drilling fluid, density of cement slurry, density of completion fluid, and top of cement.

5. The method of claim 1 wherein said determining of the well input data comprises evaluating a stress state of rock in the subterranean zone penetrated by the well bore.

6. The method of claim 5 wherein said evaluating the stress state of the rock comprises analyzing properties of the rock selected from the group consisting of Young's modulus, Poisson's ratio and yield parameters.

7. The method of claim 1 further comprising determining risk of failure for the cementing composition determined to be effective for the intended use.

8. The method of claim 1 further comprising determining at least one well event stress state associated with at least one anticipated well event; and comparing the well input data to the at least one well event stress state to determine whether the cementing composition is effective for the intended use.

9. The method of claim 8 wherein the anticipated well event comprises at least one well event selected from the group consisting of cement hydration, pressure testing, well completions, hydraulic fracturing, hydrocarbon production, fluid injection, formation movement, perforation, and subsequent drilling.

10. The method of claim 8 wherein said determining of the well event stress state comprises determining stress associated with at least one anticipated well event selected from the group consisting of shrinkage, pressure, temperature, load, and dynamic load.

11. The method of claim 1 wherein the cementing composition is selected from the group consisting of cement with a Young's modulus of about 1.2 e+6 psi (8.27 GPa), shrinkage compensated cement with a Young's modulus of about 1.2 e+6 psi (8.27 GPa), and shrinkage compensated cement with a Young's modulus of about 1.35 e+5 psi (0.93 GPa).

12. A method for selecting a cementing composition intended for use in a subterranean zone penetrated by a well bore comprising:

evaluating a stress state of rock in the subterranean zone penetrated by the well bore;

evaluating a stress state associated with the introduction of a cement composition into the well bore;

determining a hydration stress state of the cement composition in the well bore; and determining whether the cementing composition is effective for the intended use by determining whether the cement composition will de-bond from the rock.

13. The method of claim 12 wherein the evaluating of the stress state associated with the cement composition introduced into the well bore comprises using data associated with the cementing composition that comprises at least one of tensile strength, unconfined and confined fri-axial data, hydrostatic data, oedometer data, compressive strength, porosity, permeability, Young's modulus, Poisson's Ratio, and Mohr-Coulomb plastic parameters.

14. The method of claim 12 wherein said evaluating the stress state of the rock in the subterranean zone comprises analyzing properties of the rock selected from the group consisting of Young's modulus, Poisson's ratio and yield parameters.

15. The method of claim 12 further comprising determining at least one well event stress state associated with at least one anticipated well event; and determining whether the cementing composition will de-bond from the rock.

16. The method of claim 15 wherein the anticipated well event comprises at least one well event selected from the group consisting of cement hydration, pressure testing, well completions, hydraulic fracturing, hydrocarbon production, fluid injection, formation movement, perforation, and subsequent drilling.

17. The method of claim 15 wherein said determining of the well event stress state comprises determining stress associated with at least one anticipated well event selected from the group consisting of shrinkage, pressure, temperature, load, and dynamic load.

18. A method of performing a cost-benefit analysis on a cementing composition intended for use in a subterranean zone penetrated by a well bore comprising:

determining a total maximum stress difference for a cementing composition using data from the cementing composition;

determining well input data;

comparing the well input data to the total maximum stress difference to determine whether the cementing composition is effective for the intended use;

determining at least one well event stress state associated with at least one anticipated well event;

comparing the well input data to the at least one well event stress state to determine whether the cementing composition is effective for the intended use;

determining the risk of failure for the cementing composition determined to be effective for the intended use; and determining whether the risk of failure is acceptable given monetary costs associated with the cementing composition.

19. The method of claim 18 wherein the data from the cementing composition comprises at least one of tensile strength, unconfined and confined tri-axial data, hydrostatic data, oedometer data, compressive strength, porosity, permeability, Young's modulus, Poisson's Ratio, and Mohr-Coulomb plastic parameters.

20. The method of claim 18 wherein the total maximum stress difference is determined according to the formula $$\Delta\sigma_{sh} = k\int_{\varepsilon_{sh}^{set}}^{\varepsilon_{sh}^{tot}} E_{(\varepsilon_{sh})} \cdot d\varepsilon_{sh}$$

where:

$\Delta\sigma_{sh}$ is the total maximum stress difference;

k is a factor depending on the Poisson ratio of the cementing composition and the boundary conditions between rock in the subterranean zone penetrated by the well bore and the cementing composition;

$E_{(\epsilon_{sh})}$ is the Young's modulus of the cementing composition;

$\epsilon_{sh}$ represents shrinkage of the cementing composition at a time during setting.

21. The method of claim 18 wherein said determining of the well input data comprises determining at least one of vertical depth of the well, overburden gradient, pore pressure, maximum and minimum horizontal stresses, hole size, casing outer diameter, casing inner diameter, density of drilling fluid, density of cement slurry, density of completion fluid, and top of cement.

22. The method of claim 18 wherein said determining of the well input data comprises evaluating a stress state of rock in the subterranean zone penetrated by the well bore.

23. The method of claim 22 wherein said evaluating the stress state of the rock comprises analyzing properties of the rock selected from the group consisting of Young's modulus, Poisson's ratio and yield parameters.

24. The method of claim 18 wherein the anticipated well event comprises at least one well event selected from the group consisting of cement hydration, pressure testing, well completions, hydraulic fracturing, hydrocarbon production, fluid injection, formation movement, perforation, and subsequent drilling.

25. The method of claim 18 wherein said determining of the well event stress state comprises determining stress associated with at least one anticipated well event selected from the group consisting of shrinkage, pressure, temperature, load, and dynamic load.

26. A method for selecting a cementing composition intended for use in a subterranean zone penetrated by a well bore comprising:

determining a total maximum stress difference for a cementing composition using data from the cementing composition;

determining well input data;

comparing the well input data to the total maximum stress difference to determine at least in part whether the cementing composition is effective for the intended use;

determining at least one well event stress state associated with at least one anticipated well event; and comparing the well input data to the at least one well event stress state to determine whether the cementing composition is effective for the intended use.

27. The method of claim 26 wherein the data from the cementing composition comprises at least one of tensile strength, unconfined and confined ti-axial data, hydrostatic data, oedometer data, compressive strength, porosity, permeability, Young's modulus, Poisson's Ratio, and Mohr-Coulomb plastic parameters.

28. The method of claim 26 wherein the total maximum stress difference is determined according to the formula $$\Delta\sigma_{sh} = k\int_{\varepsilon_{sh}^{set}}^{\varepsilon_{sh}^{tot}} E_{(\varepsilon_{sh})} \cdot d\varepsilon_{sh}$$

where:

$\Delta\sigma_{sh}$ is the total maximum stress difference;

k is a factor depending on the Poisson ratio of the cementing composition and the boundary conditions between rock in the subterranean zone penetrated by the wellbore and the cementing composition;

$E_{(\epsilon_{sh})}$ is the Young's modulus of the cementing composition;

$\epsilon_{sh}$ represents shrinkage of the cementing composition at a time during setting.

29. The method of claim 26 wherein said determining of the well input data comprises determining at least one of vertical depth of the well, overburden gradient, pore pressure, maximum and minimum horizontal stresses, hole size, casing outer diameter, casing inner diameter, density of drilling fluid, density of cement slurry, density of completion fluid, and top of cement.

30. The method of claim 26 wherein said determining of the well input data comprises evaluating a stress state of rock in the subterranean zone penetrated by the well bore.

31. The method of claim 30 wherein said evaluating the stress state of the rock comprises analyzing properties of the rock selected from the group consisting of Young's modulus, Poisson's ratio and yield parameters.

32. The method of claim 26 further comprising determining risk of failure for the cementing composition determined to be effective for the intended use.

33. The method of claim 26 wherein the anticipated well event comprises at least one well event selected from the group consisting of cement hydration, pressure testing, well completions, hydraulic fracturing, hydrocarbon production, fluid injection, formation movement, perforation, and subsequent drilling.

34. The method of claim 26 wherein said determining of the well event stress state comprises determining stress associated with at least one anticipated well event selected from the group consisting of shrinkage, pressure, temperature, load, and dynamic load.

* * * * *